US005647102A

United States Patent [19]

Sterling, Jr.

[11] Patent Number: 5,647,102

[45] Date of Patent: Jul. 15, 1997

[54] QUICK RELEASE CLAMP

[75] Inventor: John E. Sterling, Jr., Lumberport, W. Va.

[73] Assignee: Guyan Machinery Co., Barboursville, W. Va.

[21] Appl. No.: 553,150

[22] Filed: Nov. 7, 1995

[51] Int. Cl.[6] ..... B25B 5/04

[52] U.S. Cl. ..... 24/494; 24/516; 269/238; 269/268; 269/269

[58] Field of Search ..... 24/494, 513, 516; 269/238, 268, 269; 209/405, 399, 395, 396

[56] References Cited

U.S. PATENT DOCUMENTS

| | | | |
|---|---|---|---|
| 315,542 | 4/1885 | Phipps | 269/238 |
| 946,185 | 1/1910 | Williamson | 209/405 X |
| 1,619,749 | 3/1927 | Murray | 269/238 |
| 2,577,029 | 12/1951 | Moorehead | 24/494 X |
| 2,896,293 | 7/1959 | Love | 24/494 X |
| 2,995,794 | 8/1961 | Hacking | 24/494 |
| 3,010,171 | 11/1961 | Blatt | 24/494 |
| 3,028,649 | 4/1962 | Schwarzberger | 24/494 |
| 5,037,536 | 8/1991 | Koch et al. | 209/399 X |

*Primary Examiner*—Peter M. Cuomo
*Assistant Examiner*—Hanh V. Tran
*Attorney, Agent, or Firm*—James A. Hudak

[57] ABSTRACT

A toggle-type clamping device which grippingly and compressingly engages a clamp bar in order to secure a de-watering or sizing screen within a vibrator is disclosed. The clamping device is mounted on the side of a vibrator support member that is opposite the clamp bar and includes an L-shaped clamping member which passes through an aperture in the support member permitting engagement of the clamp bar by the clamping member. The clamping member grippingly and compressingly engages the top surface of the clamp bar and the surface of the clamp bar that is opposite the support member causing the clamp bar to be compressed against the support member in the lateral direction and against the de-watering or sizing screen in the transverse direction preventing lateral and/or transverse movement thereof.

11 Claims, 3 Drawing Sheets

QUICK RELEASE CLAMP

TECHNICAL FIELD

The present invention relates, in general, to a clamping device which can be utilized to secure a member within an assembly and, more particularly, to a clamping device for securing a de-watering or sizing screen, or the like, within an industrial type vibrator and which can be easily and quickly engaged and disengaged.

BACKGROUND ART

De-watering or sizing screens in industrial type vibrators, such as those utilized in the processing of coal, are typically secured within the vibrator by a clamp bar attached to a vibrator support member through the use of a plurality of bolts passing through the clamp bar and the support member. The clamp bar is comprised of a member which, upon compression by the bolts, grippingly contacts the frame of the de-watering or sizing screen preventing any lateral movement thereof. In addition, a wedge assembly comprised of a wooden wedge and an angle iron is utilized to apply a compressive force to the clamp bar preventing any transverse movement of the de-watering or sizing screen. The angle iron portion of the wedge assembly is similarly attached to the vibrator support member through the use of a plurality of bolts passing through the angle iron and the support member. In order to remove and/or replace the de-watering or sizing screen, the wooden wedge must first be removed by striking the wedge with a hammer or a similar tool and then the plurality of bolts passing through the clamp bar must be removed permitting the removal of the clamp bar. After the foregoing bolts have been removed, the de-watering or sizing screen can be removed and replaced. After replacement, the clamp bar and the wedge assembly must be reinstalled necessitating the reinstallation of the plurality of bolts through the clamp bar and the driving of a new wedge between the angle iron and the clamp bar. The removal and replacement of the plurality of bolts through the clamp bar and the removal and replacement of the wooden wedge is a very time-consuming process resulting in significant vibrator downtime and requiring substantial labor cost.

In view of the significant downtime and labor cost associated with removing and/or replacing a de-watering or sizing screen in a vibrator application or the like, it has become desirable to develop some type of readily engageable and disengageable clamping device for securing the de-watering or sizing screen within the vibrator.

SUMMARY OF THE INVENTION

The present invention solves the problems associated with the prior art devices and other problems by providing a toggle-type clamping device which grippingly and compressingly engages the clamp bar in order to apply a compressive force to the de-watering or sizing screen preventing the lateral and transverse movement thereof. The clamping device is mounted on the side of the vibrator support member that is opposite the clamp bar and includes an L-shaped clamping member which passes through an aperture in the support member permitting the engagement of the clamp bar by the L-shaped clamping member. The inner surfaces of the L-shaped clamping member grippingly and compressingly engage the top surface of the clamp bar and the surface of the clamp bar that is opposite the support member causing the clamp bar to be compressed against the support member in the lateral direction and against the de-watering or sizing screen in the transverse direction preventing any lateral and/or transverse movement of the de-watering or sizing screen. The clamping device of the present invention is readily engageable and disengageable by moving its actuating arm and eliminates the need for bolts to secure the clamp bar to the vibrator support member and the utilization of a wooden wedge assembly.

BRIEF DESCRIPTION OF THE DRAWINGS

FIG. 1 is a cross-sectional view of prior art apparatus utilized to secure a dewatering or sizing screen within a vibrator, or the like.

DESCRIPTION OF THE PREFERRED EMBODIMENT

Figure 1:
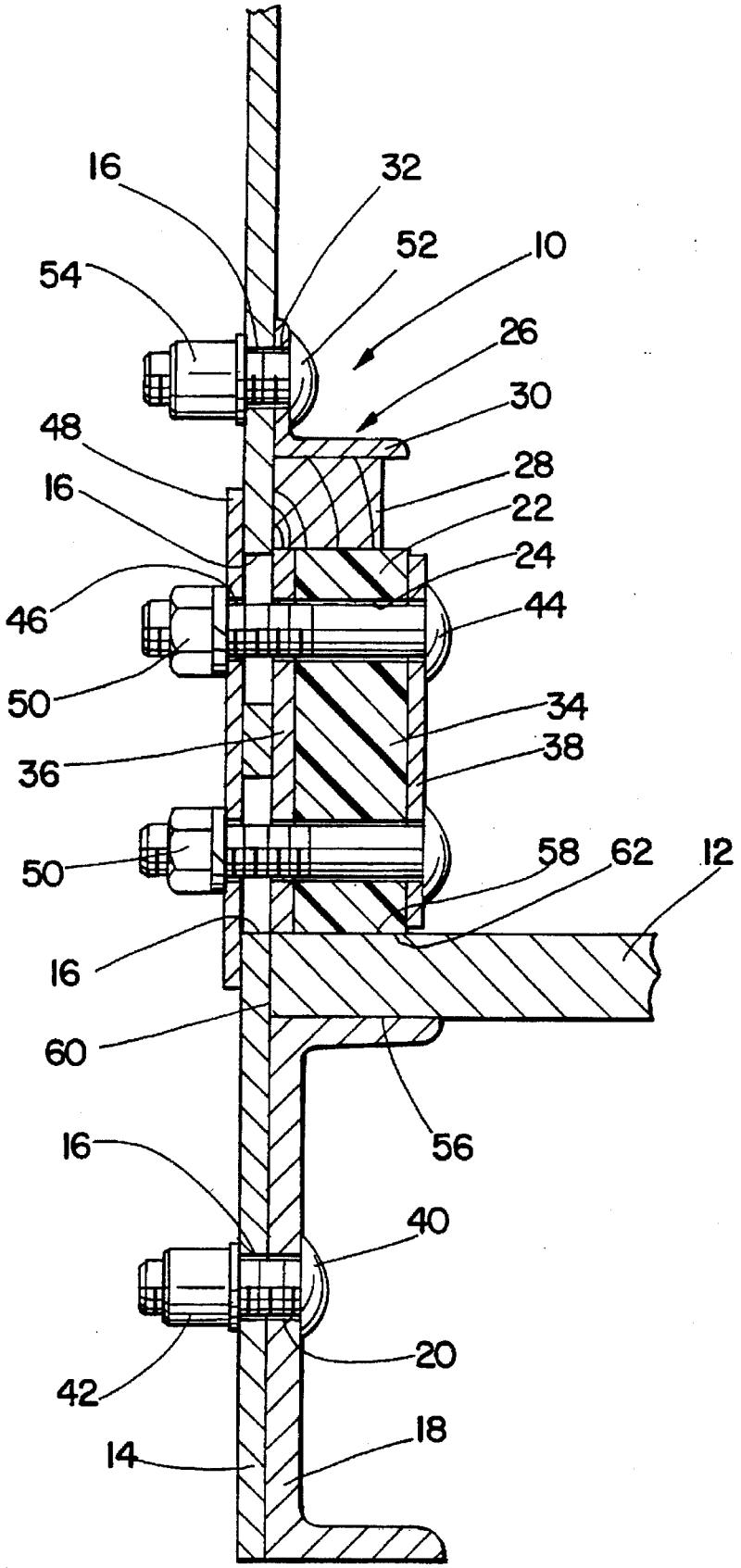
Fig. 1 (PRIOR ART)

Referring now to the drawings where the illustrations are for the purpose of describing the preferred embodiment of the present invention and are not intended to limit the invention described herein, FIG. 1 is a cross-sectional view of prior art apparatus 10 utilized to position and secure a de-watering or sizing screen 12 within a vibrator, or the like. As such, the prior art apparatus 10 is comprised of a longitudinally extending upright frame member 14, such as a metal plate, having a plurality of longitudinally and transversely spaced-apart apertures 16 therein, a longitudinally extending bottom support member 18, such as a metal channel, having a plurality of longitudinally spaced-apart apertures 20 therein, a longitudinally extending clamp bar 22 having a plurality of longitudinally and transversely spaced-apart apertures 24 therein and a wedge assembly 26 comprised of a wooden wedge 28 interposed between a longitudinally extending L-shaped member 30 having a plurality of longitudinally spaced-apart apertures 32 therein and the clamp bar 22. The clamp bar 22 is comprised of a longitudinally extending compressible member 34 interposed between an inner gasket 36 and an outer plate 38. Bolts 40 are received through apertures 20 in bottom support member 18 and aligned apertures 16 in upright frame member 14 and threadingly engage nuts 42 to fasten bottom support member 18 to upright frame member 14. Similarly, bolts 44 are received through apertures 24 in clamp bar 22 and aligned apertures 16, which are substantially larger than diameter of bolts 44, in upright frame member 14 and through longitudinally and transversely spaced-apart apertures 46 in a backing plate 48 and threadingly engage nuts 50 to fasten the clamp bar 22 to the upright frame member 14. In addition, bolts 52 are received through apertures 32 in L-shaped member 30 and aligned apertures 16 in upright frame member 14 and threadingly engage nuts 54 to fasten the wedge assembly 26 to the upright frame member 14. When assembled, the longitudinally extending edge of de-watering or sizing screen 12 is interposed between the upper surface 56 of bottom support member 18 and the bottom surface 58 of clamp bar 22. In the assembled condition, the upper surface 56 of bottom support member 18 supports the bottom of the de-watering or sizing screen 12, the outer edge 60 of the de-watering or sizing screen 12 abuts the upright frame member 14 preventing lateral movement of the de-watering or sizing screen 12, and the top surface 62 of the de-watering or sizing screen 12 is contacted by the bottom surface 58 of the clamp bar 22 preventing transverse movement of the de-watering or filter screen 12. The wedge assembly 26 provides a downwardly directed compressive force on the clamp bar 22 which, in turn, provides a downwardly directed compressive force on the de-watering or sizing screen 12 preventing transverse or vertical movement thereof.

In order to remove the de-watering or sizing screen 12, the wooden wedge 28 must be removed by striking the wedge with a hammer or a similar tool and then the bolts 44 through apertures 24 in clamp bar 22 and aligned apertures 16 in upright frame member 14 must be removed. Inasmuch as a plurality of bolts 44 are involved, the removal of same is a time consuming process and thus, the removal and replacement of the de-watering or sizing screen 12 is similarly a very time consuming process. In view of the foregoing, it has become desirable to develop a de-watering or sizing screen clamping device which is readily engageable and releasable and which does not utilize a plurality of bolts and a wooden wedge to secure the de-watering or sizing screen in a specific application.

Figure 2:
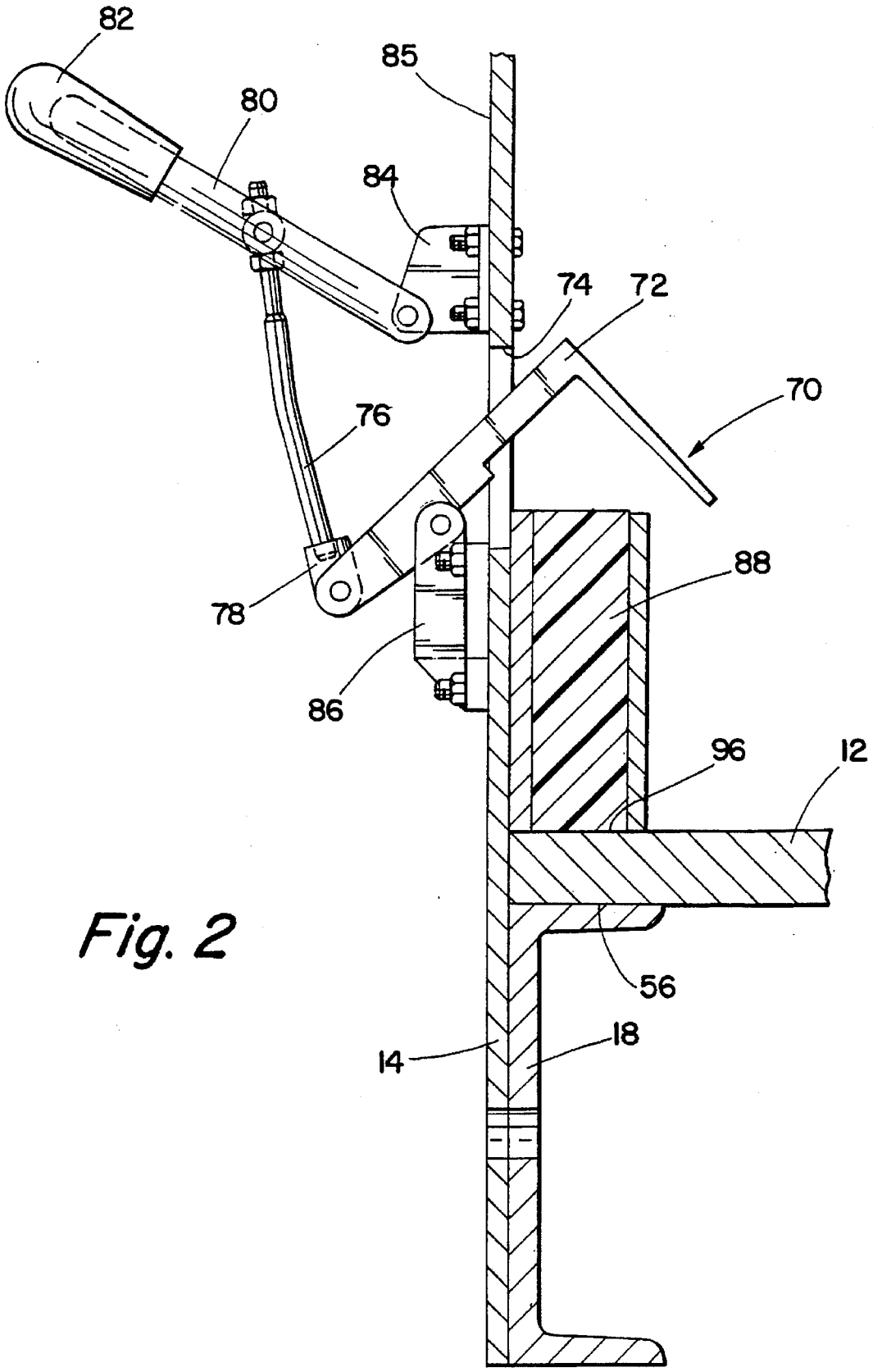
FIG. 2 is a cross-sectional view illustrating the quick release clamp of the present invention in the disengaged condition.

Referring now to FIG. 2, a cross-sectional view illustrating the quick release clamp 70 of the present invention in the disengaged condition is illustrated. In this Figure, those components which are the same as those shown in FIG. 1 carry the same reference numerals and will not be discussed further. The quick release clamp 70 of the present invention includes an L-shaped clamping member 72 which is received through an opening, shown generally by the numeral 74, in the upright frame member 14, and is rotationally connected to one end of a connecting arm 76 by means of a clevis 78. The other end of the connecting arm 76 is pivotally connected to an actuating arm 80 at its approximate midpoint. The outer end of actuating arm 80 has a hand grip 82 formed thereon. The opposite end of actuating arm 80 is interposed between and rotationally connected to a pair of connecting plates 84 which are attached to a first side 85 of the upright frame member 14. The L-shaped clamping member 72 is interposed between and pivotally attached at its approximate midpoint to the upright frame member 14 by a pair of connecting plates 86. The clamp bar 88 utilized by the quick release clamp 70 of the present invention differs from the clamp bar 22 of the prior art in that it does not have a plurality of apertures therethrough.

Figure 3:
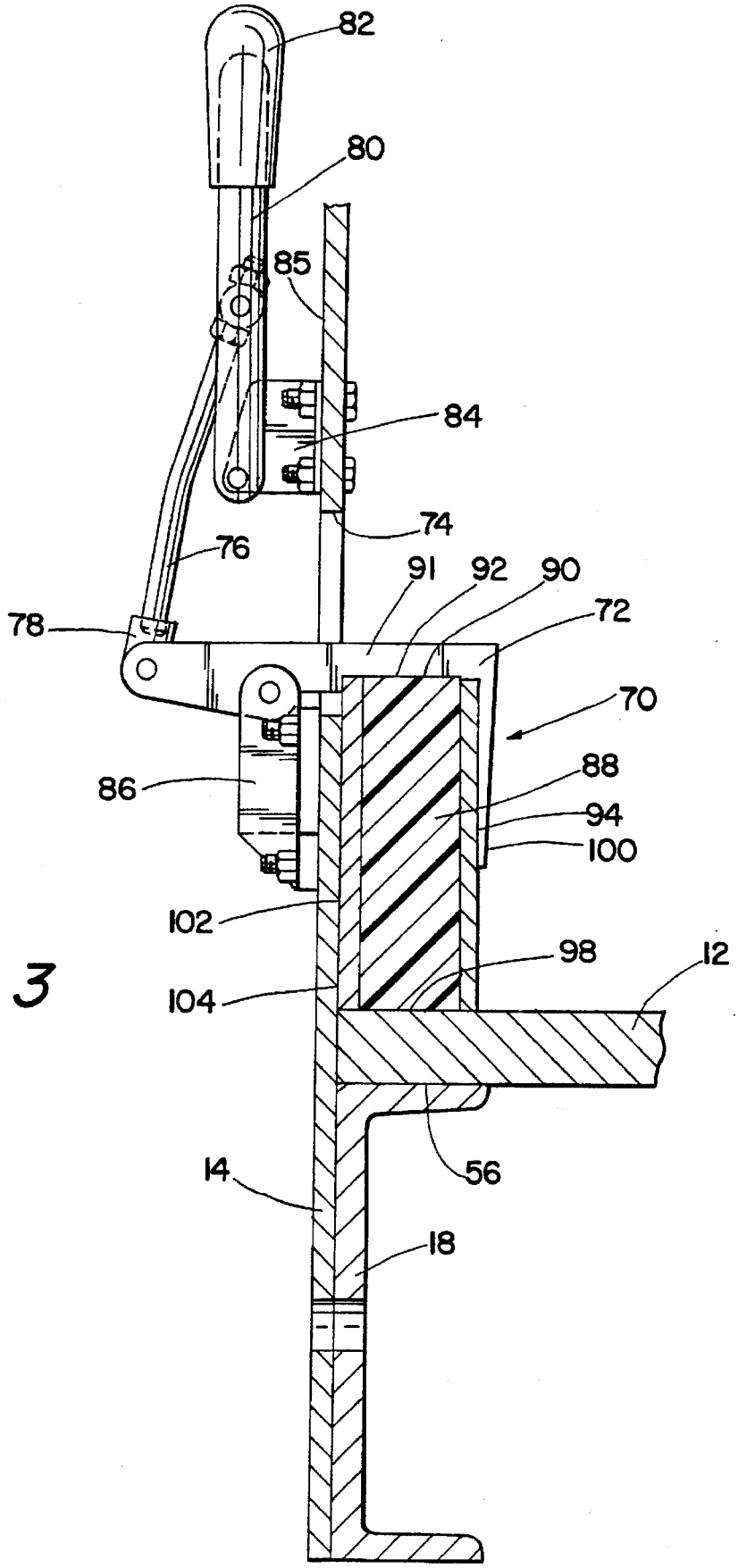
FIG. 3 is a cross-sectional view illustrating the quick release clamp of the present invention in the engaged condition.

Referring now to FIG. 3, the quick release clamp 70 of the present invention is shown in the clamped or engaged condition. When in this condition, the inner surface 90 of first portion of the L-shaped clamping member 72 compresses the top surface 92 of the clamp bar 88 in the vertical direction which, in turn, causes a first surface 98 on the clamp bar 88 to compressingly engage the screen 12, and the inner surface 94 of second portion 100 of the L-shaped clamping member 72 compresses a second surface 102 of the clamp bar 88 against a second side 104 of the upright frame member 14 in the horizontal direction. The vertically directed compressive force applied to clamp bar 88 by the first inner surface 90 of L-shaped clamping member 72 causes compression of the de-watering or sizing screen 12 against the upper surface 56 of bottom support member 18 preventing transverse or vertical movement thereof, as in the prior art. Similarly, compression of the clamp bar 88 by the inner surface 94 against the second side 104 of upright frame member 14 prevents lateral movement of the de-watering or sizing screen 12.

Referring again to FIG. 2, the quick release clamp 70 of the present invention is shown in the disengaged condition. In this case, rotation of actuating arm 80 in a counter-clockwise direction results in connecting arm 76 causing L-shaped clamping member 72 to similarly rotate in a counter-clockwise direction about connecting plates 86 and upright frame member 14. Rotation of L-shaped clamping member 72 in the counter-clockwise direction results in the disengagement of clamping member 72 from clamp bar 88 permitting the removal of clamp bar 88 and thus, the easy removal of the de-watering or sizing screen 12 without the removal of any bolts or wedges, as in the prior art. Similarly, replacement of the de-watering or filter screen 12 is a simple task and involves placing the de-watering or sizing screen 12 on bottom support member 18 so that its outer edge 60 contacts upright frame member 14, placing clamp bar 88 on de-watering or sizing screen 12 so that its bottom surface 96 contacts the top surface 62 of de-watering or sizing screen 12, and rotating actuating arm 80 in a clockwise direction causing connecting arm 76 and L-shaped clamping member 72 to similarly rotate in a clockwise direction to grippingly and compressingly engage clamp bar 88 against upright frame member 14 in both the horizontal and vertical directions preventing lateral and transverse movement of de-watering or sizing screen 12.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A clamping device for securing a screen to a frame member having an aperture therein, said clamping device comprising an actuating arm operatively connectable to a first side of said frame member, a clamping member receivable through said aperture in said frame member and operatively connectable to said first side of said frame member, a connecting arm interconnecting said actuating arm and said clamping member, said clamping member being comprised of a first portion positionable within said aperture in said frame member and a second portion connected to said first portion and oriented substantially perpendicularly with respect to said first portion, said second portion of said clamping member being positionable adjacent to a second side of said frame member, said second side of said frame member being substantially parallel to said first side of said frame member, and a clamp bar having a first surface contectable the screen to be secured and a second surface positionable adjacent to said second side of said frame member, rotation of said actuating arm in a first direction causing rotation of said clamping member in a first direction resulting in said clamping member compressible said clamp bar against said second side of said frame member and the screen to be secured, said first direction of rotation of said actuating arm and said first direction of rotation of said clamping member being substantially the same.

2. The device as defined in claim 1 wherein said actuating arm is rotationally connectable at one end thereof to said first side of said frame member.

3. The device as defined in claim 1 wherein said clamping member is pivotally mountable to said first side of said frame member.

4. The device as defined in claim 1 wherein one end of said connecting arm is pivotally connected to said actuating arm.

5. The device as defined in claim 4 wherein said one end of said connecting arm is pivotally connected to said actuating arm at the approximate midpoint of said actuating arm.

6. The device as defined in claim 4 wherein the other end of said connecting arm is pivotally connected to one end of said clamping member.

7. The device as defined in claim 1 wherein said clamping member is pivotally mountable to said first side of said frame member at the approximate midpoint of said first portion of said clamping member.

8. The device as defined in claim 1 wherein said first and second surfaces of said clamp bar are substantially perpendicular to one another.

9. The device as defined in claim 1 wherein rotation of said clamping member in said first direction causes said clamping member to compress said clamp bar in both the longitudinal and transverse directions.

10. The device as defined in claim 1 wherein rotation of said actuating arm in a second direction causes rotation of said clamping member in a second direction resulting in said clamping member disengaging said clamp bar.

11. A clamping device for securing a screen to a frame member having an aperture therein, said clamping device comprising an actuating arm operatively connectable to a first side of said frame member, a clamping member receivable through said aperture in said frame member and operatively connectable to said first side of said frame member, a connecting arm interconnecting said actuating arm and said clamping member, said clamping member being comprised of a first portion positionable within said aperture in said frame member and a second portion connected to said first portion and oriented substantially perpendicularly with respect to said first portion, said second portion of said clamping member being positionable adjacent to a second side of said frame member, said second side of said frame member being substantially parallel to said first side of said frame member, and a clamp bar having a first surface contactable the screen to be secured and a second surface positionable adjacent to said second side of said frame member, rotation of said actuating arm in a first direction causing rotation of said clamping member in a first direction resulting in said clamping member compressing said clamp bar in both the longitudinal and transverse directions and compressible said clamp bar against said second side of said frame member and the screen to be secured, said first direction of rotation of said actuating arm and said first direction of rotation of said clamping member being substantially the same direction.

* * * * *

UNITED STATES PATENT AND TRADEMARK OFFICE

CERTIFICATE OF CORRECTION

PATENT NO. : 5,647,102

DATED : July 15, 1997

INVENTOR(S) : John E. Sterling, Jr.

It is certified that error appears in the above-identified patent and that said Letters Patent is hereby corrected as shown below:

Column 4:
In claim 1, line 17, delete "contectable" and insert --- contactable with ---.

In claim 1, line 21, after "compressible" insert --- with ---.

Columns 5 and 6:

In claim 11, line 17, after "connectable" insert --- with ---.

Signed and Sealed this

Seventh Day of September, 1999

*Attest:*

Q. TODD DICKINSON

*Attesting Officer*

*Acting Commissioner of Patents and Trademarks*